United States Patent [19]

Stoll

[11] Patent Number: 4,939,869

[45] Date of Patent: Jul. 10, 1990

[54] METHOD AND APPARATUS FOR SHARPENING KNIVES

[76] Inventor: Noel E. Stoll, Post Office Box 5065, Avalon, Calif. 90704

[21] Appl. No.: 262,483

[22] Filed: Oct. 20, 1988

[51] Int. Cl.[5] ..... B24B 7/00

[52] U.S. Cl. ..... 51/109 BS; 51/92 R

[58] Field of Search ..... 51/109 BS, 92 R, 123, 51/92 BS, 231, 122, 121, 125, 217 P, 221 BS, 246, 247, 224, 285, 56 R, 218 P; 76/82, 82.1, 82.2

[56] References Cited

U.S. PATENT DOCUMENTS 2,690,037 9/1954 Meyer ..... 51/92 R 2,782,570 2/1957 Ische ..... 51/92 R

*Primary Examiner*—Frederick R. Schmidt

*Assistant Examiner*—M. Rachoba

*Attorney, Agent, or Firm*—Charles H. Thomas

[57] ABSTRACT

An accessory is provided for a conventional workshop table saw that allows the table saw to be utilized to sharpen the blades of knives. The accessory includes a channel follower adapted for engagement in a guide channel formed on the flat planar surface of the table saw. A knife cradle is connected to the channel follower and is selectively movable in a transverse direction to adjust the spacing of the knife cradle from both the guide channel and a rotary blade element slot defined in the planar work piece table top. A grinding disk is mounted as a rotary blade element in the table saw and a knife, positioned in the knife cradle, is advanced past the grinding disk to hone the knife blade.

15 Claims, 2 Drawing Sheets

FIG. 3
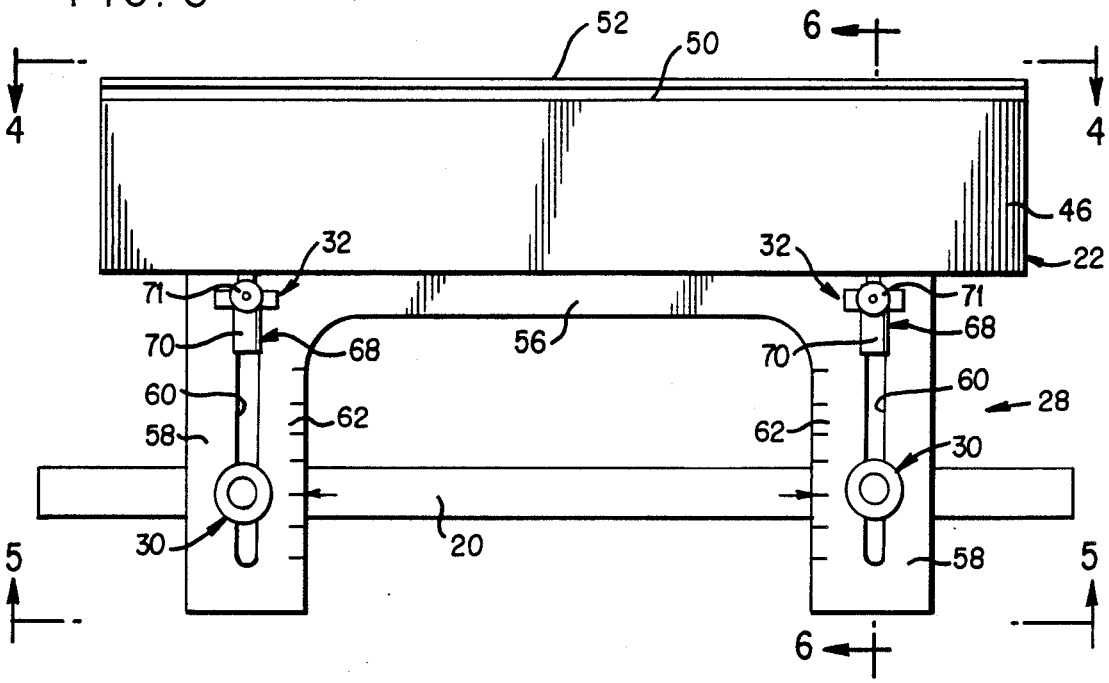
FIG. 4
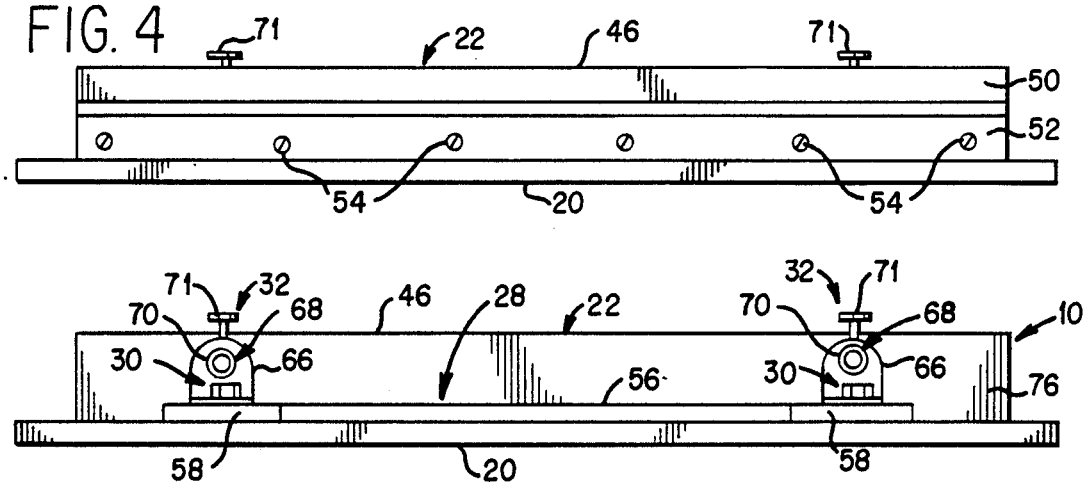
FIG. 5
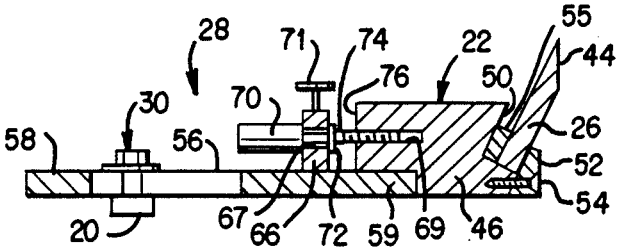
FIG. 6

METHOD AND APPARATUS FOR SHARPENING KNIVES

BACKGROUND OF THE INVENTION

1. Field of the Invention

The present invention relates to a method and apparatus for sharpening knife blades.

2. Description of the Prior Art

In the past, it has been possible to sharpen knives employed in a workshop in an automated fashion only with the aid of an expensive, special purpose knife sharpening machines. While knives that are employed in workshops may be sharpened manually on a whetstone or on a rotary grinding wheel, such a manual process is extremely laborious and very inexact. Considerable time is required to sharpen the blades of workshop knives manually using a carborundum whetstone, or by manually positioning the knife relative to a rotating grinding wheel. Moreover, in both of these manual knife sharpening techniques the blade edge achieved is highly irregular, due to recurring shifts in the angle and extent of grinding interference at which knife blade is held relative to either the grinding wheel or the whetstone. Thus, knives which are sharpened manually have significant irregularities in their edges. This detracts considerably from the quality of cuts which are achieved utilizing knives sharpened in this fashion.

In woodworking and cabinet making shops high quality knifes are used extensively to carve and shape furniture and cabinetry. However, to date, the only devices which have been satisfactorily employed for the purpose of achieving a fine, uniform cutting edge on such workshop knives are expensive, special purpose knife sharpening machines. Such knife sharpening machines do properly hold the edges of knife blades at appropriate angles and with appropriate grinding interfaces in order to sharpen knives with a uniform, accurate blade edge. However, knife sharpening machines of this type are special purpose devices and are too expensive and space consuming to be utilized in small woodworking and cabinet making shops and in conventional home workshops.

In order to properly sharpen workshop knives, an individual is forced to take the knives to a professional knife sharpening establishment for sharpening on a special purpose knife sharpening machine of the type described. This process results in a considerable delay in workshop projects, since a special trip must be made to a knife sharpening establishment during the hours that such an establishment is open. Moreover, there is a considerable expense involved, since the cost of these special purpose machines employed by knife sharpening establishments must be amortized and recovered in the cost of sharpening knife blades.

SUMMARY OF THE INVENTION

The present invention provides a means by which a person can sharpen knives used in woodworking and cabinet making shops accurately and without a major investment in special purpose knife sharpening machines which would sit idle much of the time. The present invention is an accessory for use in sharpening knives which may be utilized with any conventional table saw of the type widely used in virtually all woodworking and cabinet making shops.

In one broad aspect the present invention is a knife sharpening accessory adapted for use with a power table saw having a work piece table top, a rotary disk mounted for rotation in a plane intersecting the table top, and a guide channel defined in the table top and extending parallel to and displaced from the rotary disk. The accessory of the invention is comprised of a channel following means adapted for sliding engagement in the guide channel defined in the work piece table top, a knife cradle means adapted to hold a knife with a knife blade such that the knife blade extends parallel to the rotary disk and parallel to and in spaced separation from the channel following means when the channel following means is engaged in the guide channel, and adjustable transverse positioning means for connecting the channel following means to the knife cradle means and for adjusting the distance of separation therebetween.

One appropriate sharpening wheel or rotary blade or disk element may, for example, be a conventional carborundum disk. Any long bed knife of twenty inches or less and from one eighth to one half inch in thickness may be quickly and accurately sharpened with conventional grinding disks which are sold commercially for use on conventional workshop table saws. The accessory of the invention is particularly useful in the workshop of a cabinet maker or woodworker, since it allows such a person to perform "in house" sharpening of costly knives. The user thereby avoids the expense of investing in costly specialty equipment that is bulky and that is actually in use only a small portion of the time.

In another broad aspect the invention may be considered to be a method of sharpening a knife with a table saw having a flat planar table top with a linear guide channel defined therein and a rotary grinding element oriented to rotate in a plane parallel to the guide channel and intersecting the table top. The method of sharpening a knife according to the invention is performed utilizing an accessory including channel following means adapted to slide in longitudinal reciprocation within the channel and coupled to a knife carriage for receiving a knife to be sharpened. The steps of the method of the invention are: mounting a grinding element on the table saw, securing a knife in the knife carriage such that the knife blade extends parallel to both the guide channel and the grinding element, transversely adjusting the spacing of the knife blade relative to the grinding element, driving the grinding element in rotation, and advancing the channel following means along the channel so that the grinding element homes the knife blade.

Preferably the adjustable transverse positioning means of the accessory of the invention includes both coarse transverse adjusting means and fine transverse adjusting means. Likewise, according to the preferred practice of the method of the invention the spacing of the knife blade relative to the grinding element is transversely adjusted to achieve a selected grinding interference between the grinding disk and the knife blade.

Also, the plane of orientation of the rotary blade element or grinding disk is preferably adjusted relative to the planar table top to achieve a selected grinding interference. That is, using the tilting arbor hand wheel of the saw, the normally vertical orientation of the blade element can be adjusted to a selected angle of inclination relative to the horizontal work piece table top to match the bevel of the knife blade as it is held in the knife cradle.

The invention may be described with greater clarity and particularity with reference to the accompanying drawings.

DESCRIPTION OF THE DRAWINGS

FIG. 3 is a top plan view of the accessory of FIG. 1.

FIG. 4 is a side elevational view taken along the lines 4—4 of FIG. 3.

FIG. 5 is a side elevational view taken along the lines 5—5 of FIG. 3.

FIG. 6 is an elevational detail taken along the lines 6—6 of FIG. 3.

DESCRIPTION OF THE EMBODIMENT AND IMPLEMENTATION OF THE METHOD

Figure 1:
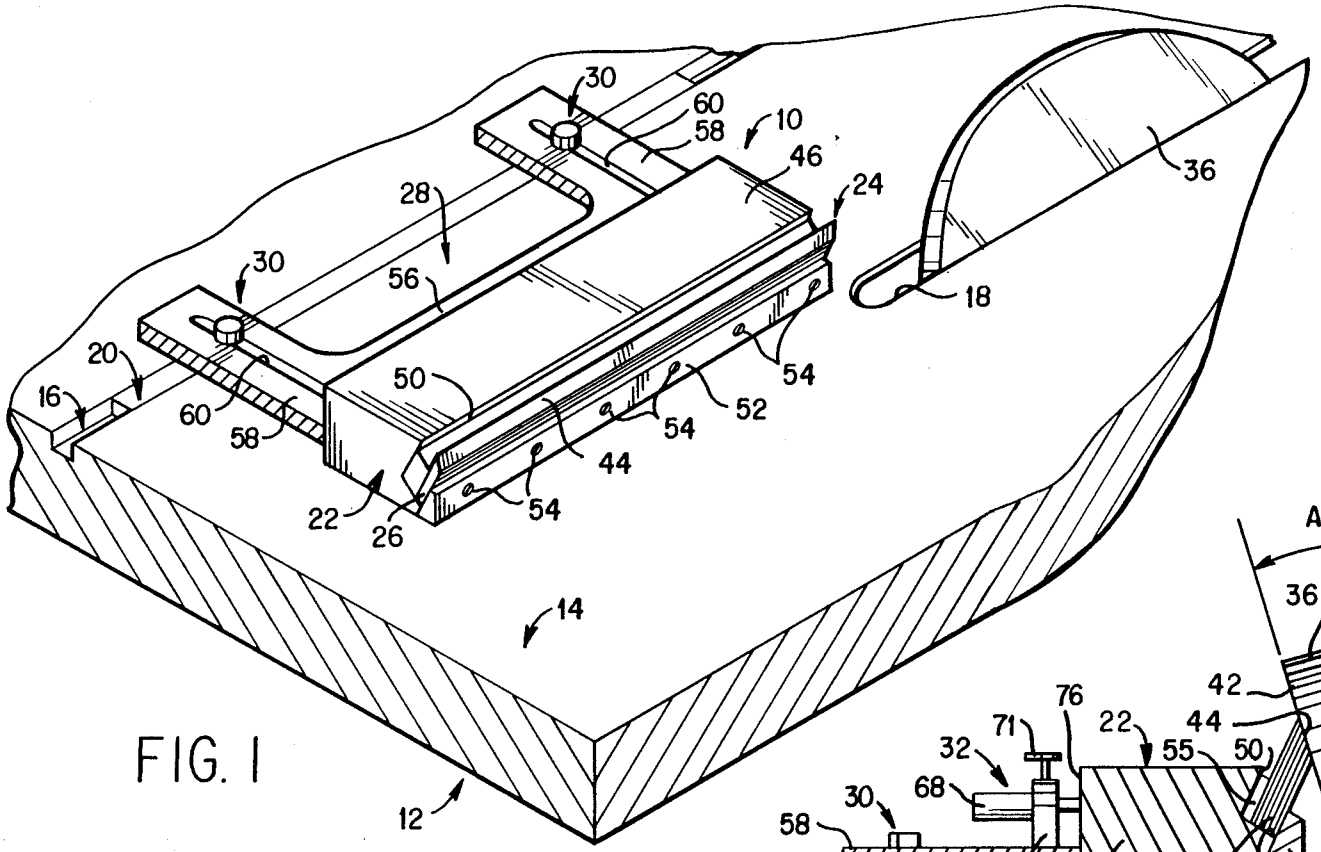
FIG. 1 is a perspective view of a preferred embodiment of the accessory of the invention as used with a table saw.

FIG. 1 illustrates a knife sharpening accessory 10 which is specially adapted for use with a table saw 12 of the type commonly utilized in woodworking and cabinet making shops, as well as in home workshops. The table saw 12 employs a flat, horizontally disposed planar work piece table 14 having a linear channel 16 of rectangular cross section defined therein. The channel 16 is milled into the top surface of the table 14 and extends parallel to an elongated, oblong rotary blade element slot 18 formed through the work piece table 14.

The knife sharpening accessory 10 is comprised of channel following means in the form of a linear bar 20 of rectangular cross section which is configured in a size and shape to smoothly ride in the channel 16 in longitudinal reciprocation therealong. The channel following bar 20 is preferably about eighteen inches in length, about three quarters of an inch in width, as measured in a direction transverse to the channel 16 and is about three eighths of an inch in thickness, as measured in the direction of the depth of the channel 16. The accessory 10 is also comprised of a knife carriage 22 for riding atop the work piece table 14 and for holding a knife 24 with its knife blade 26 parallel to both the rotary blade element slot 18 and the channel 16. The accessory 10 also includes connecting means 28 coupling the channel following means 20 and the knife carriage 22 together, and adjusting means for selectively varying the transverse distance of separation of the knife carriage 22 from both the channel 16 and the rotary blade element slot 18. In the preferred embodiment the adjusting means includes coarse transverse position selection means 30 and fine transverse position selection means 32 for respectively providing coarse and fine spacing control of the knife carriage 22 relative to the channel 16 and the rotary blade element slot 18.

The table saw 12 is a conventional, workshop table saw which employs a flat steel table top 14 in which the linear channel 16 is milled near the left-hand edge of a table top 14, as viewed from the front of the table saw 12. The table saw 12 has an arbor 34 upon which a selected rotary blade element 36 may be removable secured. Although for many cutting applications the rotary blade element 36 may take the form of a steel disk having radially outwardly directed saw teeth thereon for use in cutting wood, tile and other materials, when used with the accessory 10 the rotary blade element 36 is a grinding disk formed of an abrasive material suitable for sharpening knife blades, such as carborundum. The arbor 34 includes a locking nut 38 that may be removed from the threaded arbor stud 40 to allow different blade elements 36 to be selectively installed on the arbor 34.

Figure 2:
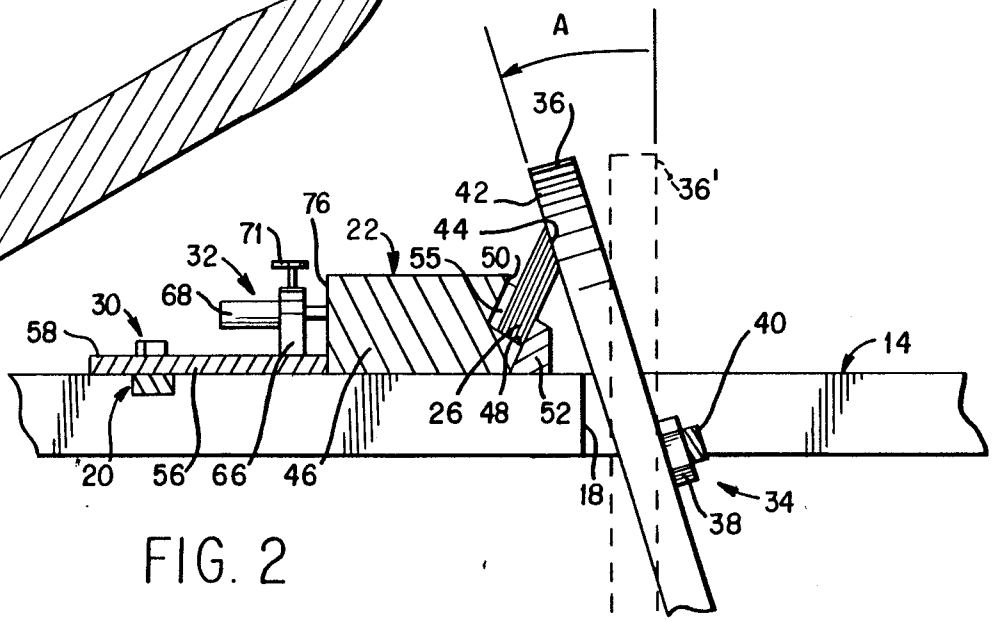
FIG. 2 is a sectional elevational view showing the use of the accessory of FIG. 1.

Conventional table saws of the type depicted at 12 normally include some means for adjusting the angle of inclination of the blade element 36 relative to the top planar surface of the table top 14. While the blade element 36 may normally be carried in a vertically upright position as depicted in phantom lines at 36' in FIG. 2, there are many cutting and grinding applications in which non-vertical orientation of the blade element 36 is desirable. Accordingly, to tilt the arbor, and thereby tilt the blade element from the position depicted at 36' to the inclined position depicted at 36 in FIG. 2, the arbor hand wheel of the table saw 12 (not shown) is rotated to move the blade element through a selected angle A to achieve the desired blade element inclination relative to the table 14. As illustrated in FIG. 2, the flat grinding surface 42 of the grinding disk serving as the blade element 36 is normally tilted to an angle such that is parallel to and matches the beveled surface 44 on the knife blade 26.

The knife cradle or carriage 22 of the blade sharpening accessory 10 is comprised of an elongated aluminum cradle block 46 having a notch 48 defined along its right-hand edge to receive a knife blade 26. The knife cradle block 46 is preferably about sixteen inches in length and about three and three eighths inches in width. The notch 48 is defined to form a right angle cut-out, although the knife blade backing face 50 along the right-hand edge of the cradle block 46 is oriented at an angle upwardly and to the right when the cradle block 46 rests atop the upper surface of the work piece table 14 of the table saw 12. In this manner the knife blade 26 can be held such that the beveled surface 44 thereof meets the grinding surface 42 of the grinding disk 36 without requiring an excessively large angle of inclination adjustment A to the arbor 34.

At the lower right-hand edge of the knife cradle 22 there is a clamping strip 52 which is secured by screws 54 that are threaded into tapped bores in the cradle block 46. To accommodate knives of different blade thicknesses, a spacer or shim strip 55 of a selected thickness may be inserted between the knife blade 36 and the blade backing surface 50. The knife carriage or cradle 22 is preferably of a size and configuration to accommodate knife blades 26 ranging between one eighth and one half inch in thickness and having a blade length of twenty inches or less.

The connecting means 28 includes a generally C-shaped base plate 56 having a pair of elongated, parallel legs 58 extending transversely to the left at its opposite ends. The legs 58 are longitudinally separated from each other such that the base plate 56 spans a distance of about twelve and three quarter inches as measured parallel to the channel 16. The legs 58 are parallel to each other and are perpendicular to both the channel 16 and to the blade element slot 18 when the channel following bar 20 rides in the channel 16. Each of the legs 58 is of a width of about two inches and is formed with an elongated, transversely oriented slot 60 therein extending away from the knife blade carriage 22. The legs 58 extend transversely across the top of the channel following bar 20.

The opposite, peripheral edge 59 of the base plate 56 extends under the hollowed out interior of the left hand portion of the cradle block 46, as viewed in FIG. 6. Preferably some track mechanism is employed between the peripheral edge 59 of the base plate 56 and the underside of the cradle block 46 so that the knife carriage 22 can only move transversely relative to the connecting means 28. For example, the peripheral edge 59 may be formed with transversely oriented guide slots (not shown) adapted to receive depending track following studs projecting downwardly from the underside of the cradle block 46.

The coarse adjusting means 30 of the accessory 10 is provided in the form of a pair of locking bolts which serve as releasable fasteners for locking the legs 58 of the base plate 56 to the channel following bar 20. A pair of longitudinally spaced tapped openings are defined in the channel following bar 20 at a distance of separation equal to the spacing between the parallel elongated slots 60 in the base plate legs 58. The locking bolts 30 have enlarged heads protruding above the legs 58 and which may be turned by hand. The bolts 30 have externally threaded shanks which extend through the slots 60 in the legs 58 and into the tapped openings in the channel following bar 20. The coarse adjusting fasteners 30 are thereby releasably tightened to clamp the bar 20 against the underside of the legs 58 so as to thereby lock the legs 58 of the base plate 56 to the channel following bar 20 to immobilize the mounting plate 56 relative to the channel following bar 20.

As illustrated in FIG. 3, scales 62 may be defined upon each of the legs 58 to provide a means for measuring the coarse adjustment selected by tightening of the coarse adjustment fasteners 30. To create a coarse adjustment the fasteners 30 are released slightly and the base plate 56 is moved transversely relative to the track following bar 20 to bring the beveled edge 44 of the knife blade 26 to be sharpened into approximate registration with the grinding surface 42 of the grinding disk 36. The fastening bolts 30 are then retightened to immobilize the base plate 56 relative to the channel following bar 20.

On the side of the base plate 56 opposite the free extremities of the legs 58 there are a pair of longitudinally spaced upright posts 66. Each of the upright posts 56 has a transversely directed opening 67 therethrough configured to receive and capture fine adjustment screws 68. The fine adjustment screws 68 have cylindrical heads 70 which are of a diameter larger than the openings 67 in the upright posts 66. C-rings 72 are secured in radial grooves extending about the outer surfaces of the shanks 74 of the fine adjustment screws 68 to prevent the fine adjustment screws 68 from moving in translation relative to the upright posts 66.

A pair of transversely oriented internally threaded bores 69 are defined in the surface 76 of the knife cradle block 46 in both vertical and longitudinal alignment with the openings 67 in the upright posts 66. The threaded shanks 74 of the fine adjustment screws 68 extend into the internally threaded bores 69 in the knife cradle block 46. By rotating the cylindrical heads 70 of the fine adjustment screws 68, the knife cradle block 46 may be moved in translation in a transverse direction perpendicular to the orientation of the channel 16 and the blade element slot 18.

The knife cradle block 46 is alternatively drawn toward the upright posts 66, or pushed away from the upright posts 66, depending upon the direction in which the fine adjustment screws 68 are turned. The fine adjustment screws 68 thereby coact with the threaded bores 69 in the cradle block 46 to form a worm drive interconnection for selectively advancing and retracting the carriage 22 relative to the channel following bar 20. The fine adjustment screws 68 and the internally threaded bores 69 serve as the worm engagement elements. The fine adjustment screws 68 thereby allow precision control of the interference between the grinding disk 36 and the knife blade surface 44 of the knife blade 26 to be sharpened.

Locking set screws 71 are threadably engaged in vertically oriented, internally tapped bores in the tops of each of the upright posts 66. When the set screws 71 are tightened, they bear against the shanks of the fine adjustment screws 68 to prevent the fine adjustment screws 68 from turning. The knife carriage 22 is thereby precluded from moving in a transverse direction.

To use the accessory 10 with the table saw 12 in accordance with the method of the invention power is first removed from the table saw 12. Any cutting blade is removed from the arbor 34 and replaced with an appropriate grinding element in the form of a wheel or disk 36. The knife to be sharpened is placed with its blade 26 in the space between the knife blade cradle block 46 and the clamping strip 52. A shim strip 55 of appropriate thickness is inserted between the backing surface 50 of the knife blade cradle block 46 and the knife blade 26. The screws 54 are then tightened so that the clamping strip 52 firmly holds the knife blade 26 on the knife blade carriage 22, with the beveled blade surface 44 to be sharpened extending upwardly and toward the grinding disk 36.

The accessory 10 is then placed atop the work piece table 14 with the channel following bar 20 in sliding engagement in the milled channel 16 in the table top 14. Any desired adjustment of the arbor 34 is performed to bring the grinding disk 36 into proper registration with the knife blade 26, and the arbor is then securely locked to create a desired angle of tilt A of the grinding disk 36 relative to the work piece table 14. The angle should be such as to match the plane of the grinding surface 42 with the desired bevel of the surface 44 of the knife blade 26.

The coarse adjustment bolts 30 are thereupon loosened and the base plate 56 is moved in a transverse directed relative to the channel following bar 20 until the blade 26 resides at a position such as to create grinding interference between the grinding disk 36 and the knife blade 26. Preferably the knife carriage 22 is moved transversely relative to the guide following bar 20 to create appropriately a one thirty second inch gap between the beveled surface 44 of the knife blade 26 to be sharpened and the grinding surface 42 of the grinding disk 36. The coarse adjustment bolts 30 are then securely fastened.

For fine adjustment the locking set screws 71 extending down into the vertically oriented tapped bores in the upright posts 66 are then loosened so that the fine adjustment screws 68 may be turned in rotation to advance the knife blade carriage 22 toward the grinding disk 36 until the knife blade 26 just makes contact with the grinding disk 36. The set screws 71 are thereupon tightened to totally immobilize the knife blade carriage 22 from transverse movement.

The accessory 10 with the knife blade 26 clamped therein is then moved longitudinally clear of the grinding wheel 36. A power switch to the table saw 12 is then turned on to thereby drive the grinding disk 36 in rotation. The accessory 10 is then moved longitudinally to advance the knife blade 26 toward the grinding disk 36, with the channel following bar 20 moving smoothly within the channel 16. As the knife blade 26 is brought into interfering relationship with the grinding disk 36, the beveled blade edge 44 is honed and sharpened.

After an initial pass of the knife blade 26 past the grinding disk 36, it may be desirable to again advance the knife blade 26 toward the grinding disk 36 for a second pass. To accomplish then, the accessory 10 with the knife blade 26 clamped therein is again moved clear of the grinding disk 36. The set screws 71 are loosened and the fine adjustment screw heads 68 are turned clockwise, to push the knife blade cradle block 46 away from the upright posts 66. The set screws 71 are again retightened and the accessory 10 is moved longitudinally toward the grinding disk 36, with the channel following bar 20 again moving within the channel 16. The process is repeated until the knife blade 26 has been sharpened satisfactorily.

Undoubtedly, numerous variations and modifications of the invention will become readily apparent to individuals familiar with workshop tools. Accordingly, the scope of the invention should not be construed as limited to the specific embodiment of the accessory and the specific implementation of the method described herein, but rather is defined in the claims appended hereto.

I claim:

1. A combination of a table saw having a work piece table top through which an elongated slot is defined, a rotary grinding disk mounted for rotation about an axis located beneath said table top and extending upwardly through said slot where it resides in a plane intersecting said table top, and a guide channel defined in said table top and extending parallel to and displaced from said rotary disk, and a knife sharpening accessory comprising a channel following means adapted for sliding engagement in said guide channel, knife cradel means adapted to hold a knife with a knife blade such that said knife blade extends parallel to said rotary grinding disk and parallel to and in spaced separation from said channel following means at a fixed orientation relative to said work piece table top when said channel following means is engaged with said guide channel, and adjustable transverse positioning means for connecting said channel following means to said knife cradle means and for adjusting the distance of separation therebetween.

2. A knife sharpening accessory according to claim 1 wherein said knife cradle means includes clamping means for holding said knife blade in a plane that is inclined relative to said table top.

3. A knife sharpening accessory for use with a table saw having a work piece table top, a rotary grinding disk mounted for rotation in a plane intersecting said table top, and a guide channel defined in said table top and extending parallel to and displaced from said rotary disk, comprising a channel following means adapted for sliding engagement in said guide channel, knife cradle means adapted to hold a knife with a knife blade such that said knife blade extends parallel to said rotary grinding disk and parallel to and in spaced separation from said channel following means when said channel following means is engaged with said guide channel, and adjustable transverse positioning means including both coarse transverse adjusting means and fine transverse adjusting means for connecting said channel following means to said knife cradle means and for adjusting the distance of separation therebetween.

4. A knife sharpening accessory according to claim 3 wherein said adjustable transverse positioning means is comprised of a base having a pair of longitudinally separated legs extending transversely across the top of said channel following means, and said coarse adjustment means includes releasable fasteners for locking said legs of said base to said channel following means at selected locations along said legs, and said cradle means is mounted for transverse movement relative to said base and said fine transverse adjusting means is comprised of parallel transversely extending tapped wells in said knife cradle means facing said base, and threaded screws captured by said base and threadably engaged in said tapped wells.

5. A knife sharpening accessory according to claim 4 wherein said channel following means is comprised of a longitudinally extending bar residing in said guide channel and located at the underside of said legs and having longitudinally spaced tapped openings therein and said releasable fasteners are comprised of a pair of bolts having heads located above said legs and shanks which extend through said legs and into said tapped openings in said bar, and said bolts are releasably tightenable to clamp said bar against the underside of said legs and hold it immobilized relative thereto.

6. The combination of a table saw having a linear channel on a planar work piece table which channel extends parallel to a rotary blade element slot on said work piece table and wherein a rotary grinding disk is mounted for rotation about an axis located beneath said work piece table and extends upwardly through said slot where it resides in a plane which intersects said table top and is parallel to said channel, and a knife sharpening accessory comprising: channel following means for riding in said channel and movable in longitudinal reciprocation therealong, a knife carriage means for riding atop said work piece table and for holding a knife with its blade parallel to both said rotary blade element slot and said channel and at a fixed orientation relative to said work piece table, connecting means coupling said channel following means and said knife carriage means together, and adjusting means for selectively varying the transverse distance of separation of said knife carriage means from both said channel and said rotary blade element slot.

7. A knife sharpening accessory according to claim 6 wherein said adjusting means is comprised of worm engagement elements interposed between said connecting means and said knife carriage means for advancing and retracting said knife carriage means in a transverse direction relative to said connecting means.

8. A knife sharpening accessory according to claim 7 wherein said connecting means includes elongated means extending from proximate said knife carriage toward said channel following means, and said adjusting means includes means for releasably securing said channel following means at selected positions along said elongated means.

9. A knife sharpening accessory for a table saw having a linear channel on a planar work piece table which channel extends parallel to a rotary blade element slot on said work piece table comprising: channel following means for riding in said channel and movable in longitudinal reciprocation therealong, a knife carriage means for riding atop said work piece table and for holding a knife with its blade parallel to both said rotary blade element slot and said channel, connecting means coupling said channel following means and said knife carriage means together, and adjusting means comprised of coarse transverse position selection means and fine transverse position selection means for respectively providing coarse and fine spacing control of said knife carriage for selectively varying the transverse distance of separation of said knife carriage means relative to both said channel and said rotary blade element slot.

10. A knife sharpening accessory according to claim 9 wherein said connecting means includes a pair of transversely oriented legs extending from said knife carriage means and passing across said channel following means and said coarse transverse position selection means is comprised of means for clamping said channel following means to said legs at selected locations therealong.

11. A knife sharpening accessory according to claim 10 wherein said legs are parallel to each other and perpendicular to both said channel and said rotary blade element slot when said channel following means rides in said channel and each of said legs is provided with an elongated transversely oriented slot therein and said means for clamping is comprised of bolts each having a head protruding above one of said legs and a threaded shank extending through one of said elongated slots and engaged in said channel following means therebeneath.

12. A knife sharpening accessory according to claim 9 wherein said fine position selection means is comprised of transversely oriented internally threaded means in said knife carriage means and transversely oriented externally threaded means carried by said connecting means and restrained from translational movement relative to said connecting means and extending into said internally threaded means in said knife carriage means, whereby said transversely oriented externally threaded means is engaged with said internally threaded means to form a worm drive interconnection for selectively advancing and retracting said knife carriage in a transverse direction relative to said channel following means.

13. A method of sharpening a knife with a table saw having a flat planar table to with a linear guide channel and an elongated slot parallel to said guide channel defined therein and a rotary grinding element mounted for rotation about an axis located beneath said table top and extending upwardly through said slot where it is oriented to rotate in a plane parallel to said guide channel and intersecting said table top utilizing an accessory including channel following means adapted to slide in longitudinal reciprocation within said channel and coupled to a knife carriage for receiving a knife to be sharpened, the steps comprising: mounting a grinding element on said table saw, securing a knife in said knife carriage such that the blade of said knife extends parallel to both said guide channel and said grinding element and in fixed orientation relative to said table top, transversely adjusting the spacing of said knife blade relative to said grinding element, driving said grinding element in rotation, and advancing said channel following means along said channel so that said grinding element hones said knife blade.

14. A method according to claim 13 further comprising transversely adjusting said spacing of said knife blade relative to said grinding element to achieve a selected grinding interference between said grinding element and said knife blade.

15. A method according to claim 13 further comprising adjusting the plane of orientation of said rotary grinding element relative to said planar table top to achieve a selected grinding interference.

* * * * *